US006075499A

United States Patent [19]

Edwards et al.

[11] Patent Number: 6,075,499

[45] Date of Patent: Jun. 13, 2000

[54] METHOD OF INSTALLATION FOR A FIXED WIRELESS ACCESS SUBSCRIBER ANTENNA

[75] Inventors: Keith Russell Edwards, Paignton; Peter John Chrystie, Galmpton, both of United Kingdom

[73] Assignee: Nortel Networks Corporation, Montreal, Canada

[21] Appl. No.: 08/942,034

[22] Filed: Oct. 1, 1997

[30] Foreign Application Priority Data

May 16, 1997 [GB] United Kingdom ..... 9709940

[51] Int. Cl.[7] ..... H01Q 3/02

[52] U.S. Cl. ..... 343/882; 343/882; 343/878; 455/562

[58] Field of Search ..... 455/456, 446, 455/562, 25; 342/357.01, 357.06, 357.08, 367; 343/882, 878, 765, 894; 248/183, 184

[56] References Cited

U.S. PATENT DOCUMENTS

| | | | |
|---|---|---|---|
| 3,510,877 | 5/1970 | Turriere | 343/882 |
| 5,212,493 | 5/1993 | Cluniat et al. | 343/882 |
| 5,419,521 | 5/1995 | Matthews | 343/882 |
| 5,446,472 | 8/1995 | Rodeffer | 343/880 |
| 5,471,219 | 11/1995 | Rodeffer et al. | 342/359 |
| 5,614,918 | 3/1997 | Dinardo et al. . | |
| 5,657,031 | 8/1997 | Anderson et al. | 343/757 |
| 5,734,356 | 3/1998 | Chang | 343/882 |

FOREIGN PATENT DOCUMENTS 2298099A 8/1996 United Kingdom .

*Primary Examiner*—Hoanganh Le
*Assistant Examiner*—Tan Ho
*Attorney, Agent, or Firm*—Lee, Mann, Smith, McWilliams, Sweeney & Ohlson

[57] ABSTRACT

This invention relates to radio communication systems and in particular relates to a method of installation for a fixed wireless access subscriber antenna. According to one aspect of the present invention there is provided a method of installing a fixed wireless access arrangement comprising one or more directive antennas operable to be directed at a base station; the method steps comprising: determining the absolute position of the location of the subscribers premises employing a radio position determining receiver; referencing data relating to the absolute position of the location of a fixed wireless access base station; positioning an antenna relative to the base station given the absolute position of the whereby initial set-up of the antenna is sufficiently accurate whereby fine tuning of the antenna is possible. By configuring the antenna mount prior to attachment on the structure, then the time required to deploy fixed wireless access subscriber equipment is much reduced.

13 Claims, 4 Drawing Sheets

METHOD OF INSTALLATION FOR A FIXED WIRELESS ACCESS SUBSCRIBER ANTENNA

FIELD OF THE INVENTION

This invention relates to radio communication systems and in particular relates to a method of installation for a fixed wireless access subscriber antenna.

BACKGROUND TO THE INVENTION

Fixed wireless systems are currently employed for local telecommunication networks, such as the IONICA fixed radio access system. Known systems comprise an antenna and decoding means which are located within a subscriber's premises, for instance adjacent a telephone. The antenna receives the signal and provides a further signal by wire to a decoding means. Thus subscribers are connected to a telecommunications network by a radio link in place of the more traditional method of copper cable. Such fixed wireless access systems will be capable of delivering a wide range of access services from POTS, ISDN to broadband data. The radio transceivers at the subscribers premises communicate with a base station, which provides cellular coverage over, for example, a 5 km radius in urban environments. A typical base station will support 500–2000 subscribers. Each base station is connected to the standard PSTN switch via a conventional transmission link/network.

When a fixed wireless access telecommunications system is originally deployed, then a base station of a particular capacity will be installed to cover a particular area. The capabilities of the base station will be commensurate with the anticipated coverage and capacity requirement. Subscribers antennas will be mounted outside, for instance on a chimney and upon installation will be directed towards the nearest base station or repeater antenna (any future reference to a base station shall be taken to include a repeater). In order to meet the capacity demand, within an available frequency band allocation, fixed wireless access systems divide a geographic area to be covered into cells. At the centre of each cell is a base station through which the subscribers stations communicate; the distance between the cells being determined such that co-channel interference is maintained at a tolerable level.

Obstacles in a signal path, such as buildings in built-up areas and hills in rural areas, act as signal scatterers and can cause signalling problems. These scattered signals interact and their resultant signal at a receiving antenna is subject to deep and rapid fading and the signal envelope often follows a Rayleigh distribution over short distances, especially in heavily cluttered regions. Since the various components arrive from different directions, there is also a Doppler spread in the received spectrum.

Correct alignment and installation of a fixed wireless access subscriber terminal towards a geographically proximate base station is essential for the correct performance of the network. At present, the lack of subscriber location precision has resulted in subscribers 'firing' across proximate base stations to more distant base stations. This causes a higher level of interference to be experienced than optimum alignment would provide. Presently, as operators of fixed wireless access systems are deploying their equipment into an already crowded telecommunications marketplace, to enable them to operate at sufficient competitive levels there must be a high rate of deployment of subscribers equipment. Obviously, such deployment must not be time consuming for installation engineers. Presently, problems have been experienced in the installation of subscribers equipment, and more particularly, in the mounting of the antennas required to transfer radio signals with a base station; the subscribers antenna must be oriented towards the base station to enable the signals to be of sufficient strength. In particular the installation engineers have reported difficulties in determining the location of the subscribers premises with respect to a proximate base station, where the techniques employed have been based on traditional cell planning and data base methods.

OBJECT OF THE INVENTION

The present invention seeks to provide a method and apparatus to improve the installation of subscribers terminals in fixed wireless access telecommunications networks.

SUMMARY OF THE INVENTION

According to a first aspect of the present invention there is provided a method of installing a fixed wireless access arrangement comprising one or more directive antennas operable to be directed at a base station; the method steps comprising:

- determining the absolute position of the location of the subscribers premises employing a radio position determining receiver;
- referencing data relating to the absolute position of the location of a fixed wireless access base station;
- positioning an antenna relative to the base station given the absolute position of the base station. The initial set-up of the antenna is sufficiently accurate to communicate radio signals with a base station, since the position can be accurate to within 1° of arc whereby only fine tuning of the antenna is necessary.

Preferably, the antenna is mounted on a multi-axis mount, which multi-axis mount has scaled gradations, wherein for a known compass orientation of the mount and inclination to the horizontal, can be configured, given data relating to the desired angular orientation and the desired azimuthal orientation of the antenna. Preferably, the radio position determining receiver is a GPS receiver which determines the position of the receiver on the earth employing data from satellites in orbit about the earth. Nevertheless other positionning systems such as Loran-C may be employed. In a preferred embodiment, the radio position determining receiver is associated with a portable computer operable to process data relating to the desired height and orientation of the antenna, which computer has stored data relating to the absolute position of fixed wireless base stations in the area, whereby an antenna mount can be oriented with respect to the structure to which the antenna will be positionned. By configuring the antenna mount prior to attachment on the structure, then the time required to deploy fixed wireless access subscriber equipment is much reduced.

In another aspect of the invention there is provided an antenna mount comprising:

- a first member suitable for attachment to a structure, having a portion suitable for attachment to a structure and a portion for attachment to an articulated member associated with the antenna body;
- a second member for attachment to the antenna and the first member;
- wherein there is a jointed portion which connects the first and second members and can adjustably determine the orientation of the antenna with respect to the structure whereby the antenna is maintained in an optimum position to exchange radio signals with a fixed wireless access base station.

In accordance with a still further aspect of the invention there is provided an antenna mount comprising:

a first member suitable for attachment to a structure, having a portion suitable for attachment to a structure and a portion for attachment to an articulated member associated with the antenna body;

a second member for attachment to the first member and to a third member;

wherein there is a jointed portion which connects the first and second members which can adjustably determine the orientation of the second member with respect to the structure;

a third member for attachment to the antenna and the second member; wherein there is a jointed portion which connects the second member and the antenna and can adjustably determine the orientation of the antenna with respect to the second member;

whereby the antenna is maintained in an optimum position to exchange radio signals with a fixed wireless access base station.

Preferably the jointed portions have scaled gradations, whereby the antenna orientation can be easily configured. The jointed portion may have a ball joint coupling arrangement. Alternatively, the jointed portions may be movable in only one angular orientation. The second member may have a rotatable portion such that the angular variation need not be either horizontal or vertical for instances when the first member cannot be positionned such that the azimuthal or elevational adjustment is not precisely such. Alternatively the first member has a rotatable portion whereby the azimuthal or elevational adjustment of the jointed portion is horizontal or vertical, respectively, as required. A still further advantage is that there is no need to know the precise location of subscriber in order to identify candidate base stations prior to a site visit. At present it is required to locate the potential subscriber on a map (latitude and longitude) then access data base for coverage.

BRIEF DESCRIPTION OF THE DRAWINGS

In order that the present invention is more fully understood, reference shall now be made to the Figures as shown in the accompanying drawing sheets, wherein.

Appendix 1 shows a flow diagram of the installation operation.

DETAILED DESCRIPTION OF PREFERRED EMBODIMENTS

Figure 1:
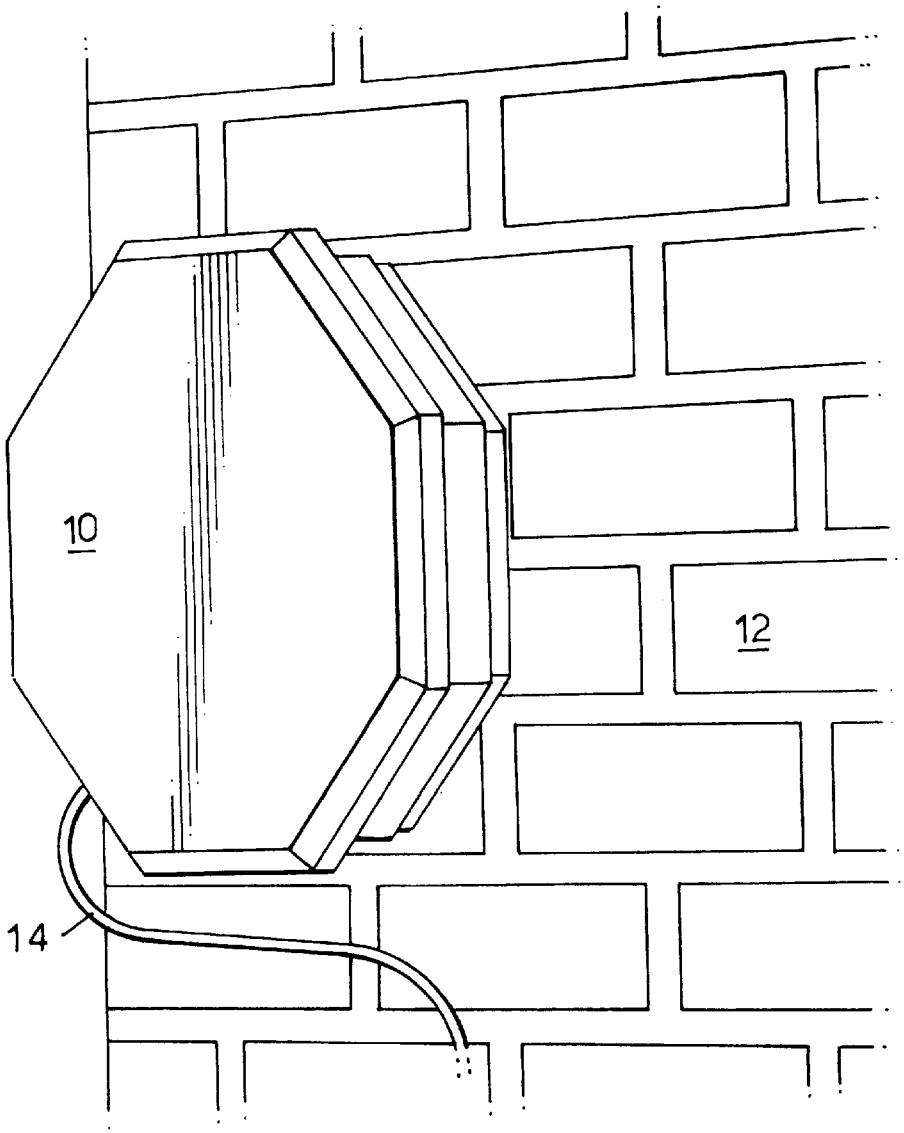
FIG. 1 is a diagrammatic perspective view of a typical installation of a fixed wireless access subscriber antenna assembly, as is known.

The integrated antenna assembly 10 shown in FIG. 1 comprises one part of a residential service system for a fixed wireless access arrangement and is mounted on a chimney breast 12 of a house—it is preferably located between fascia board level and 1–2 m above the roof top. In this case, the antenna assembly is mounted for use in a fixed wireless access (wireless local loop) telecommunications environment and is connected via a cable 14 to a junction unit for connection with standard telephone and/or facsimile equipment and a power unit.

Figure 2:
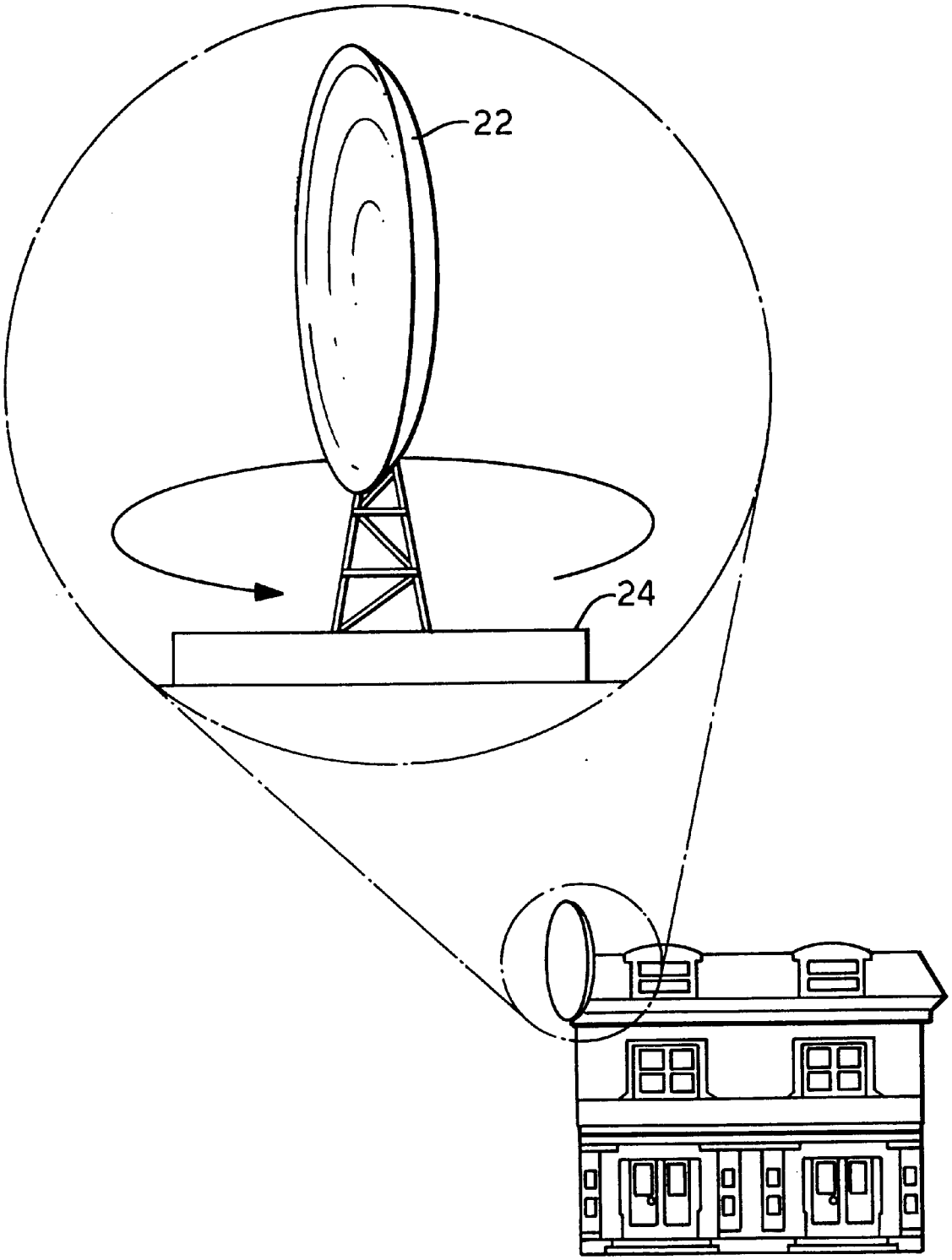
FIG. 2 shows an arrangement in accordance with the invention.

Referring now to FIG. 2, there is depicted a first embodiment of the invention, wherein the subscriber unit comprises an antenna 22 which is mounted on a support body 24 and is operable to transmit radio signals to and receive radio signals from a base station. The antenna can be directed at one or more base station antennas, depending upon the local terrain and disposition of base stations. The best received signal can accordingly be used to determine the orientation of the antenna in subsequent communications. Alternatively, the base station providing the best signal may have reached its system capacity limit and the base station providing the next best signal may be employed.

Figure 3:
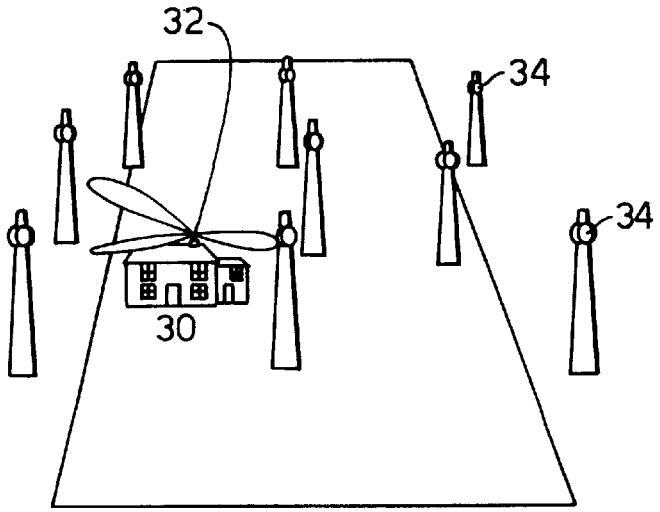
FIG. 3 shows the arrangement of FIG. 2 deployed in a cellular network.

The provision of a simple method of alignment of such an antenna with respect to a base station antenna provides the capability for some adaptive reconfiguration of the wireless local loop network, which allows maximum advantage to be taken of base station selection. FIG. 3 shows a simplified representation of a fixed radio access base station network: a subscribers premises 30 has an antenna installation 32 which enables the subscriber unit the choice of communicating with a number of adjacent base stations 34.

Figure 4A:
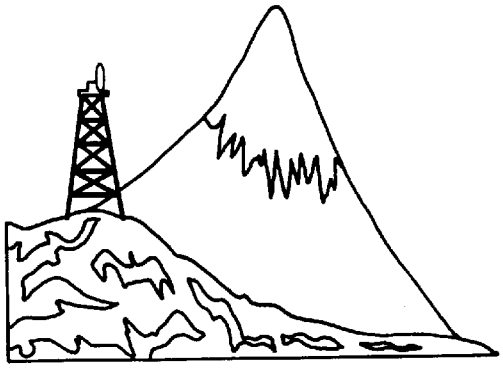
FIGS. 4*a* and 4*b* show examples of sources of fading.

Upon installation, the antenna is directed towards the nearest base station. If a building is erected such that it interferes with an optimal link with this base station, then this link may not be sufficiently strong to provide an effective link. At such times the alignment of the antenna would have to be adjusted in a similar fashion as occurred upon the original installation of the antenna whereby the antenna can achieve an optimal link. Since the antenna can communicate with any base station within range, fixed obstructions due to terrain features—see FIG. 4*a* and terrain clutter such as buildings, trees and the like, can be taken into account during installation. During deployment of base stations an accurate position fix is generally taken either based on maps or a positioning system such as the Global Positioning System (GPS). A record of all base stations (and base station identifiers—Bids) is kept and is retained on a database. Alternatively, a fix could be obtained using the base stations of the fixed wireless access arrangement to triangulte the position of the subscribers premises.

When visiting a site to install a new subscriber a computing device (e.g. a Personal Computer) in combination with a position finding device (e.g. a GPS receiver) is used to establish the closest base station(s) and display a compass bearing. A compass (or direction finding device) is then used to locate the base station signal directions. An assessment of the signal from the geographically closest base stations can then be performed. A signal measuring device which may use any antenna type can be used to establish the lowest path loss base station—in general this will be the preferred base station. If a directional antenna (preferred) is used any angular multi-path can be recorded (signal power from a reflection arriving at the site from outside the direct path) and it can be verified that the subscriber antenna is aligned with a direct radio path (rather than an angular reflection). By employing a compass in the determination of the direction of the base station, the installer can be sure that the signal is a direct signal from the base station rather than multi-path. At present strongest signal could be a multi-path that is likely to change more rapidly than a direct path.

Figure 5:
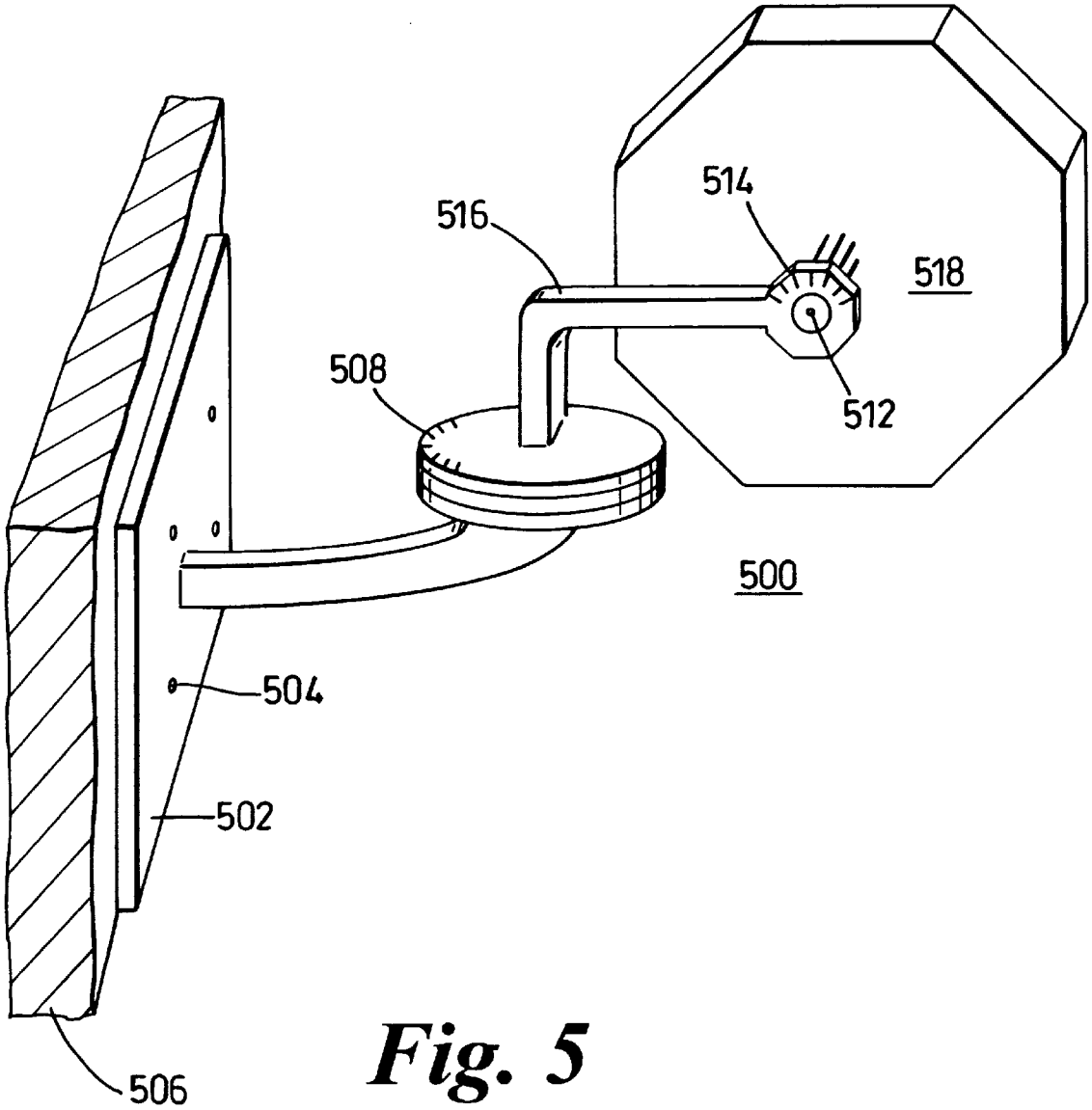
FIG. 5 details a mount for the antenna.

Once a base station has been selected, using position and height data of the base station and the position, height and orientation data of the particular mount for the antenna, an antenna mount is attached to the subscriber's residence. The mount is an adjustable mount. FIG. 5 show views of a first type of mount 500 comprising a first member 502 which possesses fastening means such as screw holes 504 for fastening using screws or bolts to be passed through into masonry, timber or the like associated with the subscribers premises 506. Using a compass, magnetic north can be determined and its position noted relative to a graded scale 508 for the azimuthal positionning of the antenna and from which the installation engineer can determine the correct azimuth orientation for the antenna. Associated with an elevation pivot 512 is a further graded scale 514 which is employed for the correct determination of the angular elevation of the antenna. In this embodiment, the first member 502 is connected to an intermediate member 516, which intermediate member is connected to a member 518 associated with, or, is an integral part of the antenna. The connection of the first member with the intermediate member defines the azimuthal orientation of the antenna whilst the connection between the intermediate member and the third member determines the elevational orientation of the antenna. The relative functions between the members could be interchanged, but it is believed that it is easier to determine the required level horizontal disposition of the mount and hence the azimuthal orientation. Alternatively, the mount can comprise two members with a lockable ball joint connecting the two.

By referencing the antenna mount to magnetic north the data can be used in the determination of the correct angular dispositions of the mounting elements relative to one another and the antenna. With the use of such a mount, upon the fixing of the first element to the wall, the rest of the mount can be assembled at ground level rather than up on a rooftop or similar, with the correct angular orientations being determined from the computer taking into account the radio positionning system details and the particular details about the subscribers premises such as the height of the intended placement, the general azimuthal field of view of the antenna etc. Once an antenna has been positionned, because of the accuracy of typical radio positionning devices being of the order of tens of meters, adjustment may be made with the assistance of micrometer adjusters, for final, optimum coupling of signals. A meter may be employed to determine the greatest received signal level in conjunction with the micrometer screw adjustment means.

Referring to Appendix 1, there is shown a flow chart which describes the installation procedure. Using a radio positionning system, such as a GPS locating system, the person carrying out the installation determines the exact co-ordinates of the site, including the proposed height of a mount for the antenna. The data so obtained is entered into a computer which has knowledge of the base stations in the vicinity, taking into account the possibility, for example, that the antenna will only be able to face a particular direction within a particular angular spread. The mount for the antenna is then installed, with a reference to magnetic north or some other reference point.

Taking into account the desired azimuth and elevational angles, the mount can be adjusted so that the antenna sits in primarily the correct orientation, which will require only small adjustment using, for example, micrometer screws with the use of a peak signal detector for optimum alignment. Redirecting the antenna would be necessary, for example, if the capacity load of the first base station is exceeded, or if it requires maintenance or upgrading, or if as previously discussed, the link with the existing base station becomes unsatisfactory. The use of the multidirectional mounting bracket will be of great benefit in such circumstances, whereby the antenna can be repositionned with respect to the azimuth and elevational gradations.

The performance of present and other presently envisaged wireless local loop or fixed radio access systems will be compromised at high microwave and millimetric frequencies due to the effects of slow temporal fading. At such high frequencies, diffraction into shadowed regions becomes less significant and therefore very high transmit powers are required. To penetrate shadowed regions. As such, the use of high frequencies is untenable. In contrast, the present invention allows a subscriber to use flexibly any one of a number of base stations which is within range.

Figure 4B:
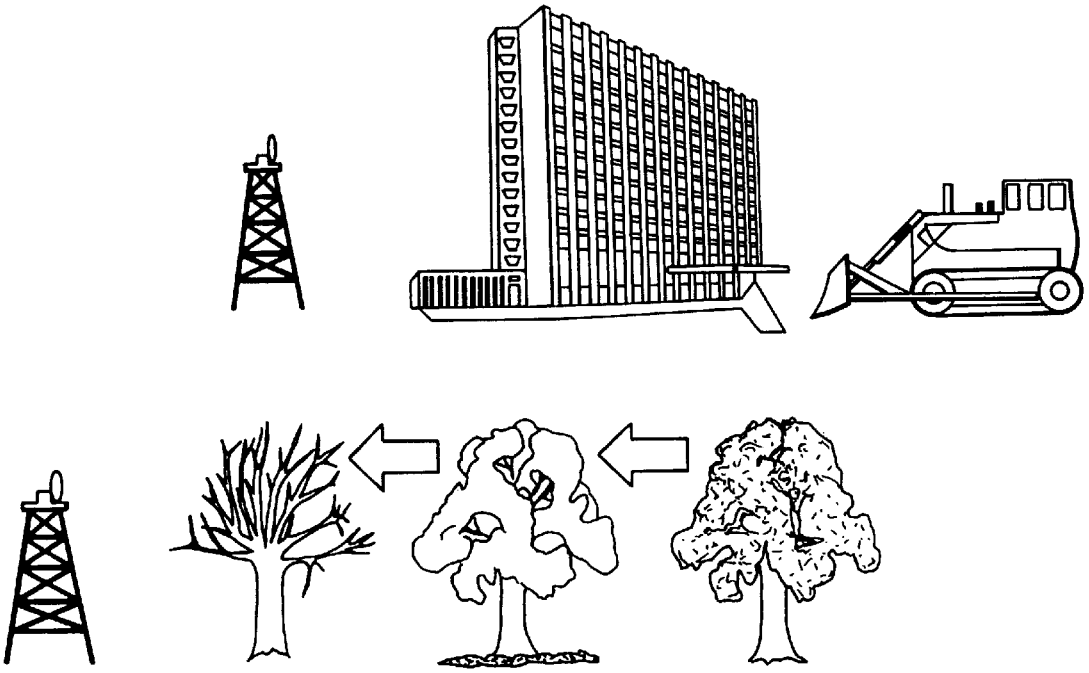

Temporally varying slow fades due to building construction, trees growing and gaining leaves can, however, cause problems. FIG. 4*b* shows examples of such sources of fading. Further problems would also arise due to increases in the numbers of subscribers and the effects of cell splitting, as a result of the provision of further base stations. Present systems would require that an installation man would need to be deployed to realign subscribers antennas as new base stations are deployed or as temporal fades occur. If the absolute position of a subscribers antenna is known, then the time required for realignment and the overall network maintenance costs are considerably reduced.

In the case of a particular base station being at its capacity limit and for traffic reasons the new antenna should not be connected to such a base station, then that base station could provide an amended broadcast control message to prevent attachment to them.

The data base for the calculating means which determines the position of the most proximate base stations may be remote and a means provided for communication between the remote computer and the data base (e.g. a mobile phone or even using the fixed wireless access system itself).

APPENDIX 1 STEP 1

Obtain base station co-ordinates;

STEP 2

Obtain co-ordinates of location where subscribers antenna is to be installed employing radio frequency positionning system;

STEP 3

Determine proposed height of antenna from ground;

STEP 4

Determine angular field of view of antenna;

STEP 5

Determine co-ordinates of proximate line of sight base stations;

STEP 6

Select base station taking into account terrain and capacity of base station;

STEP 7

Determine angle of azimuth and angle of elevation of antenna with respect to the antenna;

STEP 8

Place first mounting member on subscribers premises, ensuring that a reference point associated with first member of mount is determined;

STEP 9

Adjusting the angle of elevation of the second member with respect to the third member of the mount given data from co-ordinate calculator means;

STEP 10

Place second member of mount onto first member of mount (now attached to subscriber premises) and ensuring the angular orientation in azimuth is correct;

STEP 11

Using a peak signal detector attached to antenna, adjust orientation of antenna to maximise output of received control channel signals and securing antenna when complete.

What is claimed is:

1. A method of installing a fixed wireless access arrangement at a subscriber's premises comprising a directive antenna operable to communicate with a base station the fixed wireless access arrangement comprising; a fixed wireless access subscriber antenna mount, an antenna having a body portion and a transmit/receive portion, the mount comprising; a first member suitable for attachment to a structure, having a portion suitable for attachment to the structure and a portion for attachment to an articulated member associated with the antenna body portion; a second member for attachment to the antenna and the first member; wherein there is a jointed portion which connects the first and second members and for adjustably determining the orientation of the antenna with respect to the structure whereby the antenna transmit/receive portion can be positioned in an optimum position to exchange radio signals with a fixed wireless access base station;

the method steps comprising:

determining the absolute position of the subscribers premises by employing a GPS receiver;

determining the relative position of the subscribers premises relative to the absolute position of the fixed wireless access base station;

determining the required azimuthal and elevation orientation data of the subscribers antenna relative to the absolute position of a fixed wireless access base station; and, directing the subscribers antenna relative to the base station employing the azimuthal and elevation orientation data.

2. A method according to claim 1 wherein the radio position determining receiver is associated with a portable computer operable to process data relating to the desired height and orientation of the antenna, which computer has stored data relating to the absolute position of fixed wireless base stations in the area; whereby an antenna mount can be oriented with respect to the structure to which the antenna will be positionned.

3. A fixed wireless access arrangement comprising; a fixed wireless access subscriber antenna mount, an antenna having a body portion and a transmit/receive portion, the mount comprising;

a first member suitable for attachment to a structure, having a portion suitable for attachment to the structure and a portion for attachment to an articulated member associated with the antenna body portion;

a second member for attachment to the antenna and the first member; wherein there is a jointed portion which connects the first and second members and for adjustably determining the orientation of the antenna with respect to the structure whereby the antenna transmit/receive portion is maintained in an optimum position to exchange radio signals with a fixed wireless access base station.

4. A fixed wireless access arrangement according to claim 3; wherein the jointed portion has scaled gradations, whereby the antenna orientation can be easily configured.

5. A fixed wireless access arrangement according to claim 3; wherein the jointed portion comprises co-operating ball and socket joint portions.

6. A fixed wireless access arrangement according to claim 3; wherein said first member has a rotatable portion such that the angular disposition of one end relative to the other end may be rotated.

7. A fixed wireless access arrangement according to claim 3; wherein said second member has a rotatable portion such that the angular disposition of one end relative to the other end may be rotated.

8. An antenna mount for a fixed wireless access subscriber, the mount comprising:

an antenna having a body portion;

a first member suitable for attachment to a structure, having a portion suitable for attachment to the structure and a portion for attachment to an articulated member associated with the antenna body portion;

a second member for attachment to the first member and to a third member;

wherein there is a jointed portion which connects the first and second members which can adjustably determine the orientation of the second member with respect to the structure;

the third member being for attachment to the antenna and the second member;

wherein there is a jointed portion which connects the second member and the antenna and adjustably determines the orientation of the antenna with respect to the second member;

whereby the antenna is maintained in an optimum position to exchange radio signals with a fixed wireless access base station.

9. An antenna mount according to claim 8; wherein the jointed portions have scaled gradations, whereby the antenna orientation can be easily configured.

10. An antenna mount according to claim 8; wherein the jointed portions comprise co-operating ball and socket joint portions.

11. An antenna mount according to claim 8; wherein the jointed portions are pivotably in only one angular orientation.

12. An antenna mount according to claim 8; wherein said first member has a rotatable portion such that the angular disposition of one end relative to the other end may be rotated.

13. An antenna mount according to claim 8; wherein said second member has a rotatable portion such that the angular disposition of one end relative to the other end may be rotated.

* * * * *